US008564223B2

(12) United States Patent
Ho et al.

(10) Patent No.: US 8,564,223 B2
(45) Date of Patent: Oct. 22, 2013

(54) LIGHT PROGRAMMABLE APPARATUS WITH LIGHT PROGRAMMABLE LAMP, SETTING DEVICE, AND MAIN STRUCTURE

(75) Inventors: Yi-Ta Ho, Hsinchu (TW); Tzu-Nan Chen, Hsinchu (TW)

(73) Assignee: Lite-On It Corporation, Taipei (TW)

( * ) Notice: Subject to any disclaimer, the term of this patent is extended or adjusted under 35 U.S.C. 154(b) by 0 days.

(21) Appl. No.: 12/996,405

(22) PCT Filed: Mar. 30, 2010

(86) PCT No.: PCT/CN2010/000402

§ 371 (c)(1),
(2), (4) Date: Dec. 6, 2010

(87) PCT Pub. No.: WO2011/120190

PCT Pub. Date: Oct. 6, 2011

(65) Prior Publication Data

US 2013/0009554 A1 Jan. 10, 2013

(51) Int. Cl.
*G05F 1/00* (2006.01)

(52) U.S. Cl.
USPC ..... 315/307; 315/291; 315/308; 315/297

(58) Field of Classification Search
USPC ..... 315/192, 185 S, 185 R, 291, 294, 297, 315/299, 307, 308, 312, 361
See application file for complete search history.

(56) References Cited

U.S. PATENT DOCUMENTS

| | | | | |
|---|---|---|---|---|
| 8,242,706 | B2 * | 8/2012 | Chen et al. | 315/291 |
| 2008/0191643 | A1 * | 8/2008 | Roberts et al. | 315/300 |
| 2009/0115336 | A1 * | 5/2009 | Wang | 315/136 |
| 2009/0180271 | A1 * | 7/2009 | Jachmann | 362/20 |

* cited by examiner

*Primary Examiner* — Douglas W Owens
*Assistant Examiner* — Jianzi Chen
(74) *Attorney, Agent, or Firm* — McClure, Qualey & Rodack, LLP

(57) ABSTRACT

The invention relates to a light programmable apparatus comprising a light programmable lamp, a setting device and a main structure. The light programmable lamp is selectively electrically connected to the setting device for retrieving a light property setting such as intensity, saturation or color from the setting device. The light programmable lamp comprises: a programmable unit for retrieving and storing the light property setting while the light programmable lamp is selectively electrically connected to the setting device; and a LED module, electrically connected to the programmable unit, for emitting light corresponding to the light property setting.

24 Claims, 13 Drawing Sheets

LIGHT PROGRAMMABLE APPARATUS WITH LIGHT PROGRAMMABLE LAMP, SETTING DEVICE, AND MAIN STRUCTURE

CROSS REFERENCE TO RELATED APPLICATION

This application is the 35 U.S.C. §371 national stage of PCT application PCT/CN2010/000402, filed Mar. 30, 2010, the disclosure of which is hereby incorporated by reference.

FIELD OF THE INVENTION

The invention relates to a light apparatus. More particularly, the invention relates to a light programmable apparatus with light programmable lamps and setting device so that light programmable lamps emit light according to the light property settings provided by the setting device.

BACKGROUND OF THE INVENTION

FIGS. 1A, 1B, and 1C represent a traditional incandescent bulb 11, a fluorescent light tube 13 and a compact fluorescent lamp (CFL) 15 respectively. Generally speaking, traditional lamps and lanterns are not capable of changing properties of the light emitted once they are manufactured. In other words, properties of the light emitted from theses devices are fixed as soon as they are manufactured, and users are not able to change the light properties according to their preferences. For instance, the only option for a user to change the light color of a lamp is to buy another bulb with different light color and replace the original one. However, it will cost extra money to purchase more bulbs and need extra space to store spare bulbs.

The limitation of light properties provided by traditional lamps results in that users have to spend money and time in purchasing and changing extra bulbs in order to have multiple choices of light properties. Although some lamps are combined with controllers for providing advanced functions, these controllers are used to control the interval, period or intensity of the light but not the light color. Besides, although some lamps provide several types of light colors for user to choose, the light colors supported are limited. Therefore, users can select only a certain types of light colors provided when the lamp is produced.

Due to the restrictions on the types of light properties provided by traditional lamps, the flexibility of traditional lamps is confined.

SUMMARY OF THE INVENTION

The present invention aims to provide a light programmable apparatus whose light properties such as color, saturation and intensity are changeable and offer the feasibility for a user to change the light property as s/he wishes.

The primary objective of the present invention lies in providing a light programmable lamp selectively electrically connected to a setting device. The light programmable lamp comprises: a programmable unit, for retrieving and storing the light property setting while the light programmable lamp is selectively electrically connected to the setting device; and a LED module, electrically connected to the programmable unit, for emitting light corresponding to the light property setting.

The secondary objective of the present invention is to provide a setting device. The setting device provides a light property setting for a light programmable lamp. The setting device comprises a setting controller for retrieving and providing the light property setting to the light programmable lamp while the light programmable lamp is selectively electrically connected to the setting device.

Another objective of the present invention is to provide a light programmable apparatus comprising: a setting device for providing a first light property setting; a first light programmable lamp, selectively electrically connected to the setting device, wherein the first light programmable lamp comprises: a first programmable unit for retrieving and storing the first light property setting while the first light programmable lamp is selectively electrically connected to the setting device; and a first LED module, electrically connected to the first programmable unit, for utilizing power and emitting a first light corresponding to the first light property setting. The light programmable apparatus further comprises a main structure, wherein the first light programmable lamp is removably arranged on the main structure.

BRIEF DESCRIPTION OF THE DRAWINGS

The above-objects and advantages of the present invention will become more readily apparent to those ordinarily skilled in the art after reviewing the following detailed description and accompanying drawings, in which.

DETAILED DESCRIPTION OF PREFERRED EMBODIMENTS

In order to solve the problem that light properties of lamps are restricted as soon as the lamps are manufactured, the invention provides a light programmable lamp with two different function modes, i.e. the setting mode and the operation mode. The following description will first explain how the two modes are concerned, followed by the implementation details described by block diagrams. An embodiment of a honeycomb-like implementation is then demonstrated, and various potential applications are mentioned. Unlike the prior art that leaves the light property setting stage at manufactories, the present invention provides lamps the setting mode for changing light properties settings such as color, saturation or intensity, and the operation mode for emitting light, wherein the light emitted is corresponding to the light property settings.

The light programmable apparatus proposed in this invention mainly comprises components like a setting device 21, a light programmable lamp 23, and a main structure 25. Based on the two function modes and components mentioned above, the core of this invention is: when a light programmable lamp 23 is selectively electrically connected to a setting device 21 in the setting mode, the light programmable lamp 23 will be programmed by the setting device 21, for selecting a light property setting from a plurality of light property settings provided by the setting device 21. On the other hand, when the light programmable lamp 23 is in the operation mode, the light programmable lamp 23 is selectively electrically connected to a main structure 25 like a lamp holder, and emits a light corresponding to the light property setting stored in the setting mode.

As the setting device 21 and the main structure 25 are provided for different functionalities and used with the light programmable lamp 23 in different function modes, the physical connection between each of them and the light programmable lamp 23 are switchable and removable.

Since the core thinking of this invention is to provide two types of function modes of a light programmable lamp 23, the setting device 21 and the main structure 25 can be configured separately or combined to a single device. FIG. 2A~2F further discuss two different types of implementations for the light programmable lamp 23, the setting device 21, and the main structure 25. For each implementation, the connection diagrams are first introduced, followed by the detail connections and explanation of internal signals between each device.

In the first type of implementation, FIGS. 2A, 2B, 2C and 2D represent a separate connection of the setting device 21 and the main structure 25. That is, the light programmable lamp 23 is either connected to the setting device 21 in the setting mode or arranged on the main structure 25 in the operation mode. As for the second type of implementation, FIG. 2E and FIG. 2F demonstrate an example that combines the setting device 21 and the main structure 25 together.

Figure 1A:
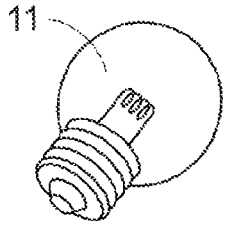
FIG.1A (Prior Art)
FIGS. 1A, 1B and 1C illustrate a traditional incandescent bulb, a fluorescent light tube and a CFL lamp, respectively.
Figure 1B:
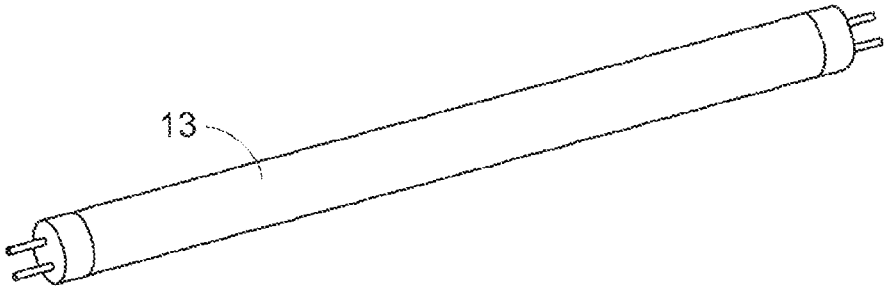
FIG.1B (Prior Art)
Figure 1C:
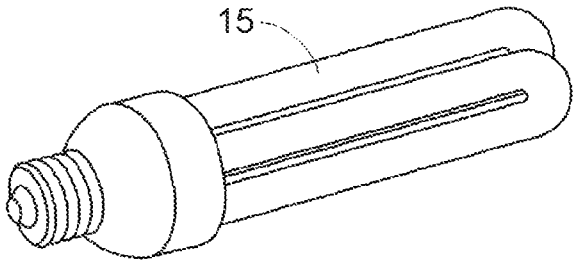
FIG.1C (Prior Art)
Figure 2A:
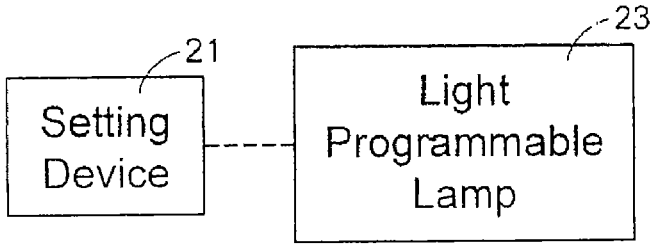
FIG. 2A is a block diagram showing a light programmable lamp and a setting device in the setting mode.

FIG. 2A is a block diagram showing a light programmable lamp 23 and a setting device 21 in the setting mode. The setting device 21 provides a first light property setting for the light programmable lamp 23 while the light programmable lamp is selectively electrically connected to the setting device 21.

Figure 2B:
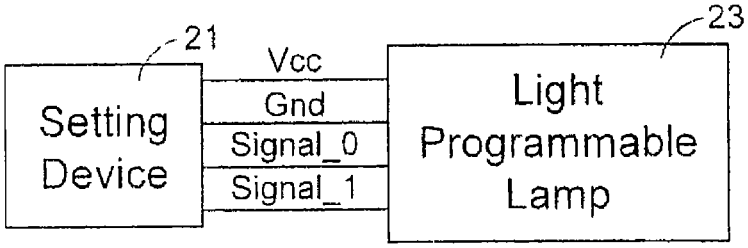
FIG. 2B represents the internal connections between the setting device and the light programmable lamp.

FIG. 2B represents the internal connections between the setting device 21 and the light programmable lamp 23. The setting device 21 uses Vcc line and Gnd line to provide the power needed by the light programmable lamp 23. Besides, the setting device 21 and the light programmable lamp 23 use signal lines (signal_0 and signal_1) for property settings. In other words, when the light programmable lamp 23 is connected to the setting device 21, the setting device 21 provides the power via Vcc line and Gnd line, and the light property settings via the signal lines.

Figure 2C:
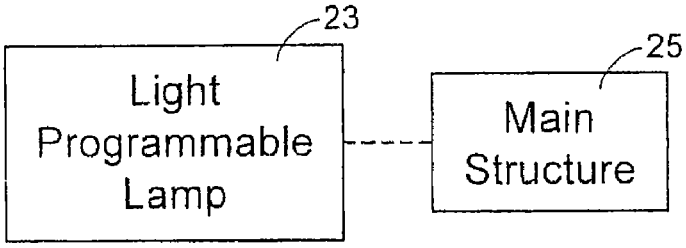
FIG. 2C is a block diagram showing a light programmable lamp and a main structure in the operation mode.
Figure 2D:
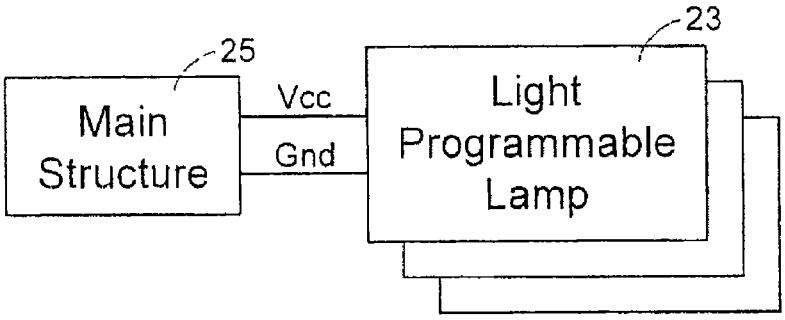
FIG. 2D demonstrates the internal connections between the light programmable lamp and the main structure.

FIG. 2C is a block diagram showing a light programmable lamp 23 and a main structure 25 in the operation mode. In the operation mode, the light programmable lamp 23 is selectively electrically connected to the main structure 25, which is taken as a lamp holder. FIG. 2D demonstrates the internal connections between the light programmable lamp 23 and the main structure 25 in the first type of implementation. The main structure 25 uses Vcc line and Gnd line to provide the DC current in order to trigger the light programmable lamp 23 for light emitting.

Figure 2E:
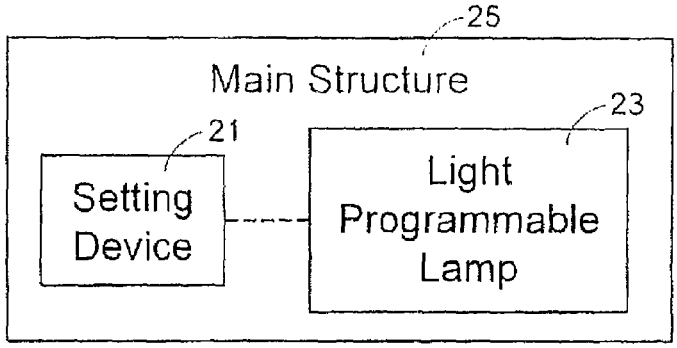
FIG. 2E is a block diagram showing another embodiment of light programmable apparatus wherein the setting device and the light programmable lamp are removably arranged on the main structure.
Figure 2F:
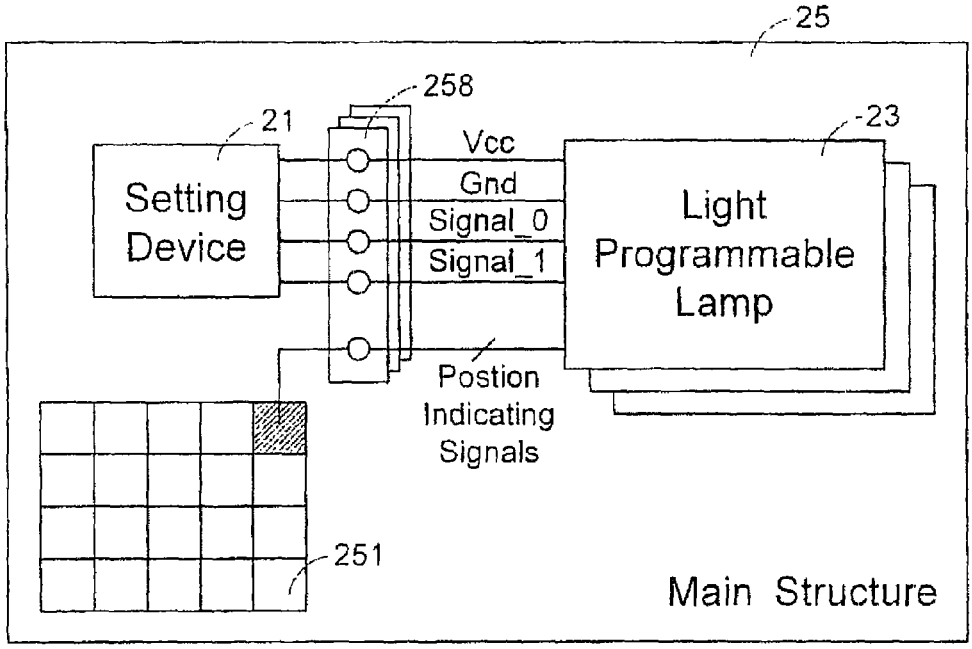
FIG. 2F is an internal connection diagram discloses the detail connections among the main structure, the light programmable lamp, and the setting device.

FIG. 2E is a block diagram showing a light programmable apparatus wherein the setting device 21 and the light programmable lamp 23 are removably arranged on the main structure 25. FIGS. 2E and 2F represent the second type of implementation of the present invention, that is, to combine the main structure 25, the light programmable lamp 23, and the setting device 21 as a single module.

FIG. 2F is an internal connection diagram discloses the detail connections among the main structure 25, the light programmable lamp 23, and the setting device 21. Similarly, there are Vcc line and Gnd line between the setting device 21 and the light programmable lamp 23 for the power transmission. Besides, the signal_0 and signal_1 are provided for light property setting as well.

It should be noted that the line connections mentioned here represent the linking concept of property setting and power supply, therefore, the practical implementation may vary. In other words, the number of the line connections between the setting device 21 and the light programmable lamp 23 should not be limited.

In FIG. 2F, the main structure 25 further comprises a position indicating circuit 2.51 and a plural number of connectors 258. The position indicating circuit 251 provides a hot plug function for the light programmable lamp 23 while the light programmable lamp 23 is removably arranged on the main structure 25. As for the connector 258, it is used for providing an interface between the light programmable lamp 23 and the setting device 21.

In the first type of implementation, the light programmable lamp 23 is selectively electrically connected to the setting device 21 and the main structure 2.5 respectively. On the other hand, the setting deice 21 is embedded in the main structure 25 and both are electrically connected to the light programmable lamp 23 in the second type of implementation. In other words, any two of the setting device 21, the light programmable lamp 23 and the main structure 25 can be selected as a detachable design or a combinative design.

Although the setting device 21 and the main structure 25 can be implemented separately or integrally, the core thinking of providing light property settings for the light programmable lamp 23 in the setting mode, and allowing the light programmable lamp 23 to emit light according to the light property setting in the operation mode is the same. Therefore, the only difference between these two implementations is the physical layout. As for the signal transmission and light property settings between the setting device 21, the light programmable lamp 23 and the main structure 25 are similar.

Based on the core thinking of the two different function modes mentioned above, it is easy to find out the present invention focuses on fulfillment of the light programmable lamp with two different function modes; hence the application of this invention can be various.

Figure 3A:
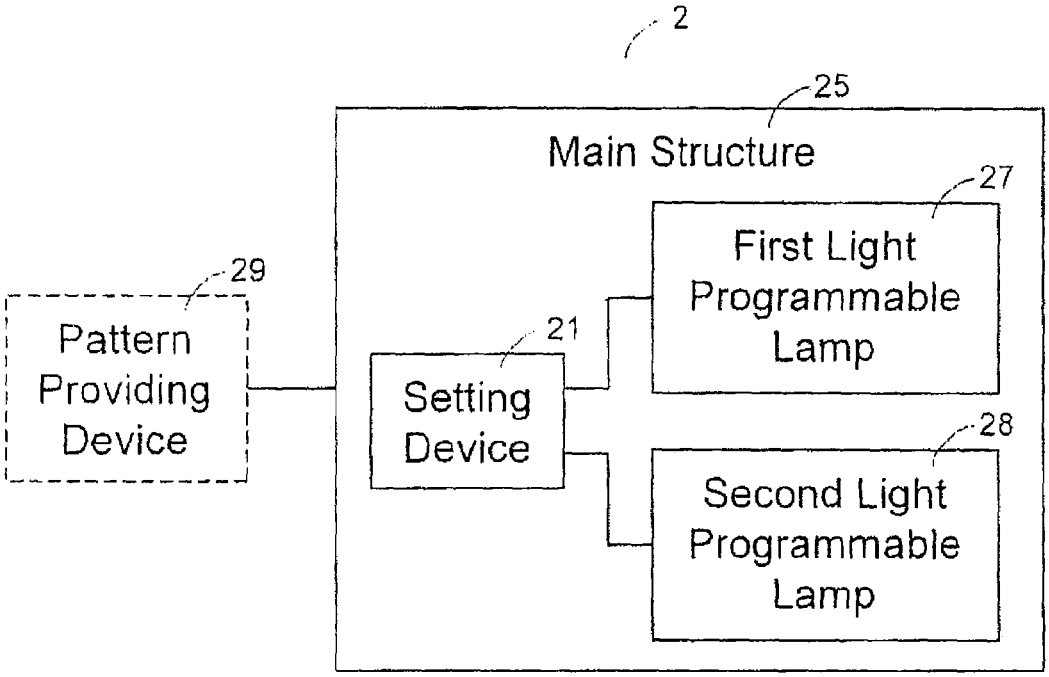
FIG. 3A is a block diagram of a further embodiment of a light programmable apparatus.

FIG. 3A is a block diagram of a further embodiment of a light programmable apparatus. The light programmable apparatus 2 comprises two light programmable lamps (first light programmable lamp 27 and second light programmable lamp 28), a setting device 21 and a main structure 25. Both light programmable lamps 27, 28 and the setting device 21 are removably arranged on the main structure 25.

In the case that the light programmable apparatus 2 contains multiple light programmable lamps 27, 28, the light programmable apparatus 2 may further comprise other components to enhance the property setting function provided by the setting device 21. For example, the setting device 21 may be selectively electrically connected to a pattern providing device 29 via a connector using a USB or RJ45 or serial interface to fetch some related information for the pattern setting, wherein the pattern setting represents a figure, a picture, or a design as a combination of the multiple light programmable lamps. Due to the variety of choices of high technology media products, the choices of the pattern providing devices 29 may vary. For example, a PC, a digital camera or a digital album might be used as the pattern providing device 29.

Figure 3B:
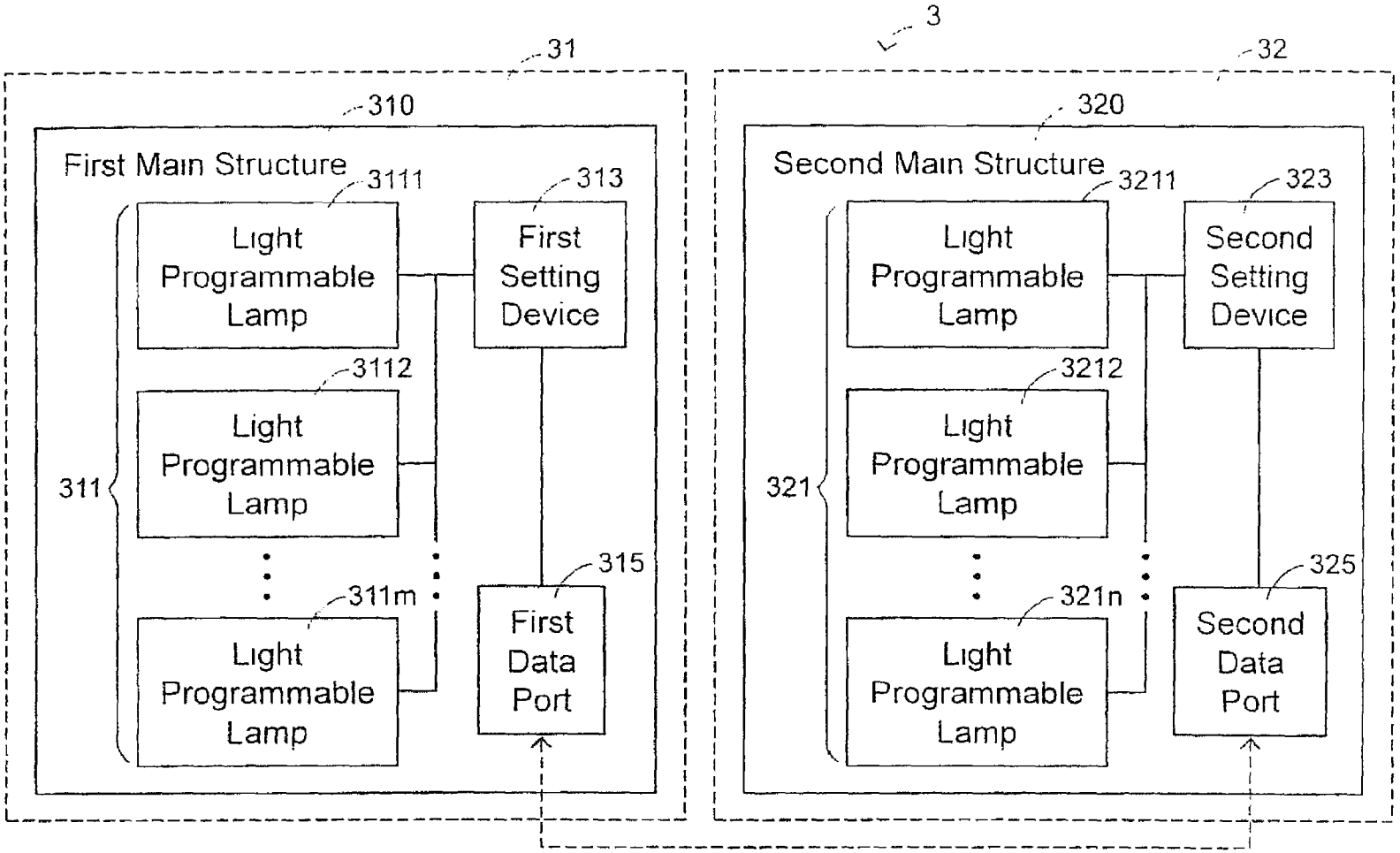
FIG. 3B is a block diagram of a light programmable system.

FIG. 3B further applies the invention to a light programmable system 3 composed of several light programmable apparatuses 31, 32. The light programmable system 3 comprises a first light programmable apparatus 31 and a second light programmable apparatus 32, wherein the light programmable apparatuses 31, 32 are in communication with each other via the data ports 315, 325 through a cable or a wireless network.

To explain in details, the first light programmable apparatus 31 comprises: a first main structure 310, a first setting device 313, and a first group of light programmable lamps 311; similarly, the second light programmable apparatus 32 comprises: a second main structure 320, a second setting device 323, and a second group of light programmable lamps 321. Each light programmable apparatus 31, 32 is accompanied with a data port 315, 325 for transmitting and receiving light property is settings to and from an another light programmable apparatus, wherein the first data port 315 is electrically connected to the first setting device 313 and the second data port 325 is electrically connected to the second setting device 323.

According to FIG. 3B, the first setting device 313 is embedded in the first main structure 310, capable of providing a first set of light property settings; and the first group of light programmable lamps 311 are selectively electrically connected to the first main structure 310, for emitting a first plurality of lights according to the first set of light property settings. The first plurality of lights are combined to display a first pattern, wherein the first set of light property settings are either received from the first data port 315 or provided by the first setting device 313.

On the other hand, the second setting device 323 is embedded in the second main structure 320, capable of providing a second set of light property settings; and the second group of light programmable lamps 321 are selectively electrically connected to the second main structure 320, for emitting a second plurality of lights according to the second set of light property settings. The second plurality of lights are combined to display a second pattern, wherein the second set of light property settings are either received from the second data port 325 or provided by the second setting device 323.

The light programmable apparatuses 31, 32 are capable of communicating with and transferring data between each other. Instead of displaying the two different patterns individually, the first light programmable apparatus 31 and the second programmable apparatus 32 may display identical or sequential pattern via the communication between the first data port 315 and the second data port 325.

In the first light programmable apparatus 31, the first data port 315 is electrically connected to the first setting device 313, for transmitting the first set of light property settings; while in the second light programmable apparatus 32, the second data port 325 is electrically connected to the second setting device 323 and in communication with the first data port 315, for receiving the first set of light property settings from the first data port 315 and transmitting them to the second setting device 323.

As the first data port 315 and the second data port 325 are in communication through a cable or a wireless network, the apparatuses 31, 32 are able to share the light property settings for each other. Therefore, according to the light programmable system 3 above, the first set of pattern settings and the second set of pattern settings may be the same or different.

The explanations above provide a general overview of the usage and application of the proposed light programmable apparatuses 31, 32 and system 3, and the descriptions below will further discuss the internal components composing the light programmable apparatuses 31, 32 and system 3.

Figure 4A:
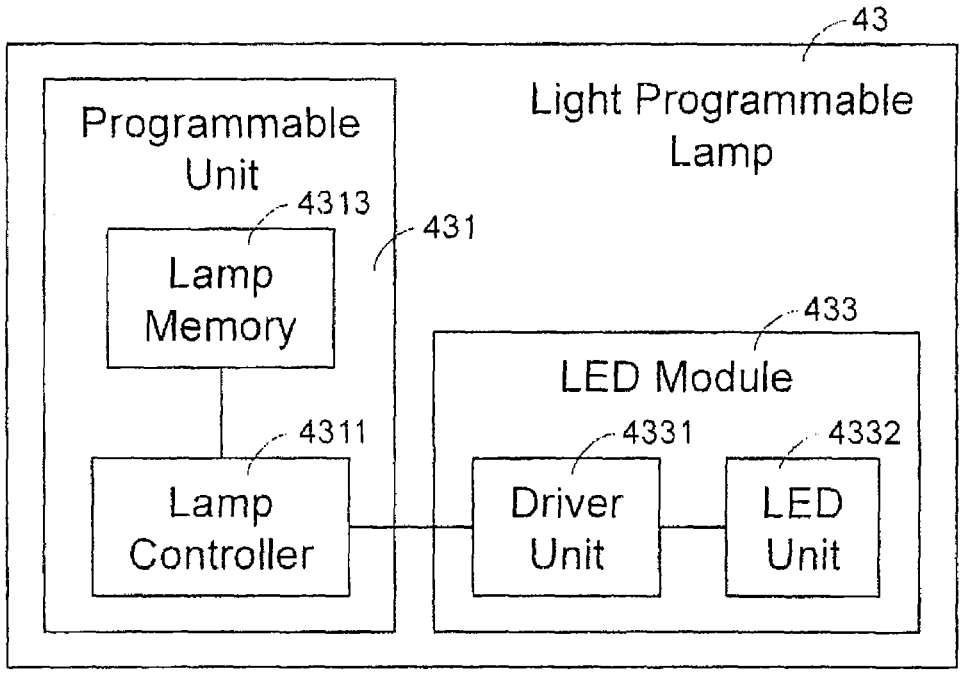
FIG. 4A is a block diagram showing a light programmable lamp for emitting a single color light or a white light.

FIG. 4A is a block diagram showing a light programmable lamp 43 for emitting a single color light or a white light. In this implementation, the light programmable lamp 43 comprises a LED module 433 and a programmable unit 431. The programmable unit 431 retrieves and stores the light property setting while the light programmable lamp 43 is selectively electrically connected to a setting device (not shown in FIG. 4A) in the setting mode.

While fetching the light property setting stored in the lamp memory 4313, the lamp controller 4311 is capable of converting the light property setting to a light signal received by the LED module 433.

The LED module 433 is used for emitting light in operation mode, wherein the light is corresponding to the light property setting. The LED module 433 comprises a driver unit 4331 and a LED unit 4332, and it is electrically connected to the programmable unit 431. The driver unit 4331 is electrically connected to the lamp controller 4311. After the driver unit 4331 receives the light signal from the lamp controller 4311, it will generate a driving current for the LED unit 43.32, wherein the LED unit 4332 and the driver unit 4331 are electrically connected. By doing so, the LED unit 4332 will emit a light in response to the driving current.

In FIG. 4A, the light emitted from the light programmable lamp 43 may be in a single color or in white color, and the light property setting may concern with the intensity, saturation and color of the light.

Figure 4B:
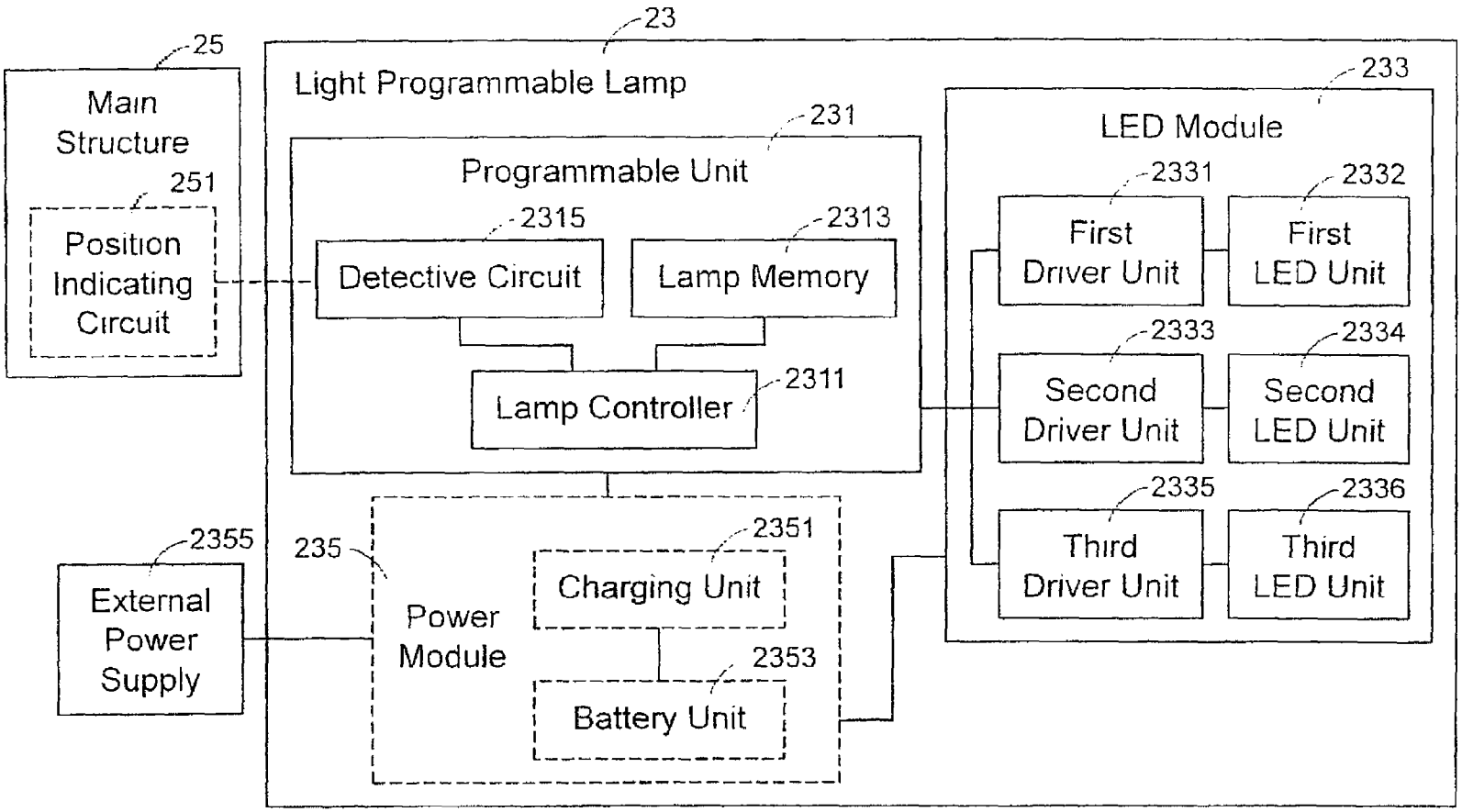
FIG. 4B is a block diagram showing a light programmable lamp capable of emitting a mixed color light.

FIG. 4B is another block diagram showing a light programmable lamp 23 capable of emitting a mixed color light. As mentioned earlier, the light programmable lamp 23 can be defined in two function modes. In the setting mode, the light programmable lamp 23 is selectively electrically connected to a setting device 21, wherein the light programmable lamp 23 retrieves a first light property setting from the setting device 21.

The core of the light programmable lamp 23 comprises: a programmable unit 231 and an LED module 233. The programmable unit 231 is used to retrieve and store the light property setting while the light programmable lamp 23 is electrically connected to the setting device 21. As for the LED module 233, it is electrically connected to the programmable unit 231 to emit light corresponding to the first light property setting.

Except the components for emitting light and providing light property setting, the light programmable lamp 23 may further comprise a power module 235, electrically connected to the programmable unit 231 and the LED module 233, for providing power utilized by the LED module 233.

As for the internal elements of the power module 235, it may vary according to the source of power supply type. For instance, the power module 235 may comprise a battery unit 2353, electrically connected to the LED module 233, for providing the power. It is possible to provide a charging unit 2351, electrically connected to the battery unit 2353, for charging the battery unit 2353 from an external power supply 2355. Therefore, the light programmable lamp may receive the source of the power by switching between an external power supply 2355 and a built-in battery unit 2353.

Regarding the internal components of the programmable unit 231, there are at least a lamp memory 2313, for storing the light property setting, and a lamp controller 2311. The lamp controller 2311 is electrically connected to the lamp memory 2313 and the LED module 233, and the lamp controller 2311 is used for fetching the light property setting from the lamp memory 2313 and controlling the LED module 23.3 to emit the light according to the light property setting.

In order to provide the light property setting for the light programmable lamp 23 emitting light corresponding to the light property, the lamp controller 2311 is capable of converting the light property setting to a group of signals that is received by a group of driver units, and these driver units will further generate a group of driving currents to a group of LED units.

To explain in more details, the lamp controller 2311 is capable of converting the light property setting to a first light signal, a second light signal and a third light signal. Relatively, the LED module 233 comprises a first driver unit 2331, electrically connected to the lamp controller 2311, for receiving the first light signal from the lamp controller 2311 and generating a first driving current; a second driver unit 2333, electrically connected to the lamp controller 2311, for receiving the second light signal from the lamp controller 2311 and generating a second driving current; and a third driver unit 2335, electrically connected to the lamp controller 2311, for receiving the third light signal from the lamp controller 2311 and generating a third driving current.

The LED module 233 further comprises a first LED unit 2332, electrically connected to the first driver unit 2331, for emitting a first light in response to the first driving current; a second LED unit 2334, electrically connected to the second driver unit 2333, for emitting a second light in response to the second driving current; and a third LED unit 2336, electrically connected to the third driver unit 2335 for emitting a third light in response to the third driving current.

As mentioned above, the LED module 233 may comprise several LED units. Therefore, it is possible to adopt the R-G-B light generating approach, that is, let the first LED unit 2332 be a red color LED unit, the second LED unit 2334 be a green color LED unit, and the third LED unit 2336 be a blue color LED unit. The mixture of the first light, the second light, and the third light is equivalent to a mixture of a red color light, a green color light and a blue color light so that the light programmable lamp 23 is possible to generate different types of mixed color light by changing the output intensity of each LED unit.

In other words, the mixed color light emitted from the light programmable lamp 23 is made of the first color light, the second color light and the third color light whose intensities are dependent on the first driving current, the second driving current and the third driving current. To be more precisely, these driving currents are controlled by the first light signal, the second light signal and the third light signal individually.

As the light signals converted from the light property setting such as color, saturation or intensity are generated by the lamp controller 2311, it can be easily conclude that the light property setting provided by the lamp memory 2313 is the key of the mixed color light. Therefore, as long as the light property setting is modified, the mixed color light emitted from the light programmable lamp 23 will be changed.

Although the example above adopts the R-G-B concept and uses it as light property settings, but the details in the light property setting may vary. For example, it is possible for the setting device to provide the light property setting in H-S-V format. In other words, as long as the light programmable lamp 23 is capable of recognizing the light property settings provided by the setting device, the details of how the property setting is represented should not be limited.

In the case that the light programmable lamp 23 is used together with other light programmable lamps, there might be a need to position each light programmable lamp. In such application, the main structure 25 may provide a position indicating circuit 251 for providing a position signal to the light programmable lamp 23, and the programmable unit 231 may comprise a detective circuit 2315, electrically connected to the position indicating circuit 251 embedded in the main structure 25, for detecting the position signal corresponding to the light programmable lamp 23.

According to different purposes, the light programmable lamp 23 can be combined with different devices for its usage. For example, the light programmable lamp 23 may be used individually, and it is like a color changeable flash light. Once a user wants to change the properties of the light emitted from the light programmable lamp 23, s/he needs only to connect the light programmable lamp 23 to the setting device 21, select the light property setting s/he prefers and store the light property setting in the light programmable lamp 23. At the end, the light programmable lamp 23 will emit light with different light properties such as a different light color as the user wishes.

No matter the usage of the light programmable lamp 23 is with mobility as a flashlight or not, it is possible for the light programmable lamp 23 to further comprise a power module 235. The power module 235 is electrically connected to the programmable unit 231 for providing the power utilized by the LED module 233. Looking further inside the internal components of the power module 235, the power module 235 may further comprise a battery unit 23.53 and a charging unit 2351.

Being electrically connected to the LED module 233, the battery unit 2353 is able to provide power for LED module 233. As for the charging unit 2351 electrically connected to the battery unit 2353, it will charge the battery unit 2353 from an external power supply 2355. In other words, it is possible for the light programmable lamp to receive the source of the power by switching between an external power supply 2355 and a built-in battery unit 2353.

As for the layout of the programmable unit 231, there might be a lamp memory 2313 for storing the first light property setting; and a lamp controller 2311, electrically connected to the lamp memory 2313 and the LED module 233, for fetching the first light property setting from the lamp memory 2313 and programming the LED module 233 to emit the light.

Instead of the approach that uses the memory unit to store position information for the light programmable lamp 23, the programmable unit 231 may comprise a detective circuit 2315 like an ADC circuit that is capable of detecting the relative position of a light programmable lamp 23 among a plurality of light programmable lamps removably arranged on the same main structure 25. While the light programmable lamp is electrically connected to the main structure 25, the detective circuit 2315 inside the light programmable lamp 23 will be electrically connected to a position indicating circuit 251 embedded in the main structure 25. Therefore, the detective circuit 2315 is capable of detecting a position signal of the light programmable lamp 23.

According to the different applications, the shape of the light programmable lamp 23 is various. For instance, the light programmable lamp 23 may be in the shape of a bulb, a fluorescent tube, a small dish or a honeycomb cell. Of course, the number of LED modules embedded in the light programmable lamp 23 does not need to be limited. Therefore, it is also possible to have several LED modules to compose the programmable lamp 23.

Figure 5:
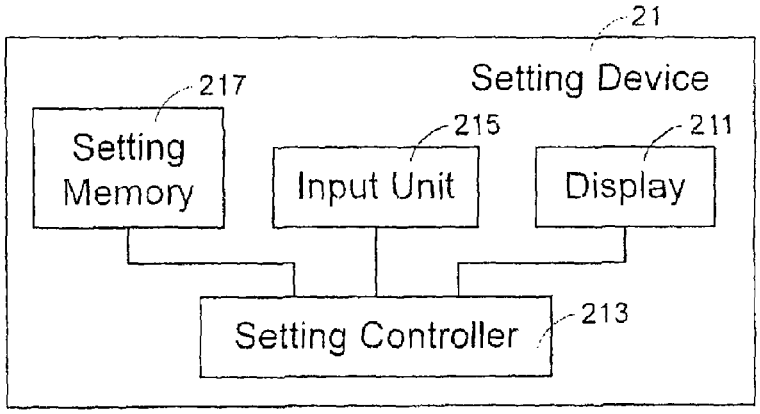
FIG. 5 is a block diagram of a setting device.

FIG. 5 is a block diagram for the setting device 21 used to preset light property settings for the light programmable lamps 23. The setting device 21 comprises: a setting controller 213, retrieving and providing the light property setting to the programmable lamp 23 while the light programmable lamp 23 is selectively electrically connected to the setting device 21.

Varied from the sources that provide the setting controller 213 for the light property setting, the setting device 21 may further comprise a setting memory 217 or an input unit 215 to provide the light property setting from internal or external paths.

In the case that uses a setting memory 217 for providing the light property setting, the setting memory 217 is electrically connected to the setting controller 213, for providing a light property mapping table including a plurality of light property settings.

In the application that receives light property setting from devices outside the setting device 21, the setting device 21 may further comprise an input unit 215, electrically connected to the setting controller 213, for fetching a user defined light property setting and providing the light property setting to the setting controller 213. According to the system application, the detail implementation of the input unit 215 may vary.

For instance, the input unit 215 can be implemented as a color sensor, for detecting the light property setting via a color reader. For another example, the input unit 215 may be implemented as a push button, encoder or touch screen/panel . . . , etc, for receiving the light property setting via a user's operation.

It is possible to provide some components in the setting device 21 to ease the use of setting process. For example, the setting device 21 may further comprise a display 211, electrically connected to the setting controller 213, for showing detail attributes of the light property setting.

Once we combine the implementation of the light programmable lamp 23, the setting device 21 and a main structure 25, this invention further provides a light programmable apparatus 2. The light programmable apparatus 2 comprises: a plurality of light programmable lamps removably arranged on the main structure 25, wherein the position of each light programmable lamp is changeable.

Figure 6:
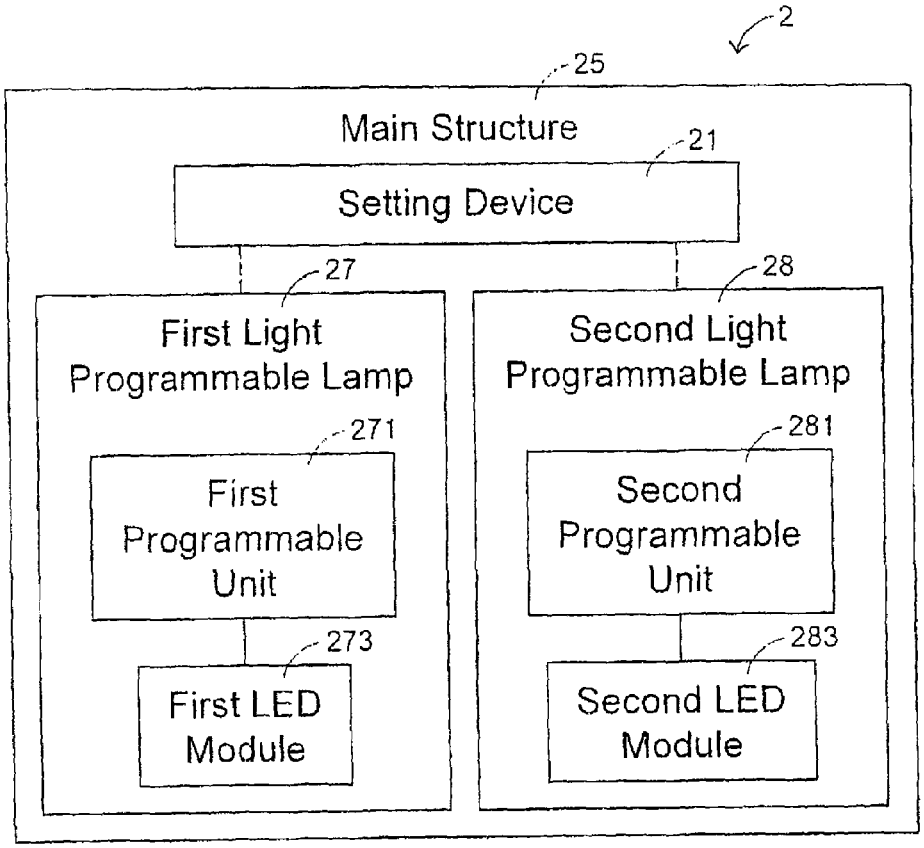
FIG. 6 is a block diagram of a light programmable apparatus with two light programmable lamps.

FIG. 6 is a block diagram for the light programmable apparatus 2 proposed by the invention. The light programmable apparatus 2 comprises: a setting device 21 for providing a first light property setting, a first light programmable lamp 27 selectively electrically connected to the setting device 21, and a main structure 25. The first light programmable lamp 27 comprises: a first programmable unit 271 for retrieving and storing the first light property setting while the first light programmable lamp 27 is selectively electrically connected to the setting device 21; and a first LED module 273, electrically connected to the first programmable unit 271, for utilizing electronic power and emitting a first light corresponding to the first light property setting. The first light programmable lamp 27 is removably arranged on the main structure 25.

For the sake of convenience, in the embodiment of the light programmable apparatus 2, the setting device 21 is embedded in the main structure 25. The light programmable apparatus 2 further comprises: a second light programmable lamp 28 selectively electrically connected to the setting device 21, wherein the setting device 21 provides a second light property setting.

Similar to the internal layout of the first light programmable lamp 27, the second light programmable lamp 28 comprises: a second programmable unit 281 for retrieving and storing the second light property setting while the second light programmable lamp 28 is selectively electrically connected to the setting device 21; and a second LED module 283, electrically connected to the second programmable unit 281, for utilizing electronic power and emitting a second light corresponding to the second light property setting.

The first programmable unit 271 and the second programmable unit 281 may further retrieve and store the first and the second light property setting of setting device 21 for controlling the behavior of the first light and the second light respectively such as duration time.

In the case that combines the light programmable lamp 23, the setting device 21, and the main structure 25 as a single device, the light programmable apparatus is capable of providing a hot plug function. This hot plug function can be achieved via the position indicating circuit 251 and the connectors 258 embedded in the main structure 25.

With the position indicating circuit 251, the position of the light programmable lamp 23 is specifically identified as soon as the light programmable lamp 23 is placed on the main structure 25. As for the connectors 258, they are used as an interface between the light programmable lamp 23 and the setting device 21, for transmitting relevant signals such as different light property settings according to various position indicating results.

As the light property settings provided in both light programmable lamps are individual, the first light property setting and the second light property setting may be the same or different. Some advanced functions may also be provided in the light programmable apparatus 2. For example, in order to identify the position of each light programmable lamp 27, 28, the main structure 25 may comprise a position indicating circuit for providing a position signal to the light programmable lamps 27, 28, as described before. Besides, the light programmable apparatus 2 may further provide a hot plug positioning function. When each programmable lamp 27, 28 is plugged to the main structure 25, its geometry position information relative to the main structure 25 stored in lamp memory 2313 will be reconfigured by its position indicating circuit 251 in order to receive the light property command from the setting device 21 with specific position addressed. Alternatively, the lamp memory may dynamically store the address provided by the position indicating circuit 251 during the hot plug operation. With this positioning technique, the main structure 25 can produce versatile geometry light property pattern combined by the plurality of lamps 27, 28. In addition, when the first programmable lamp 27 is plugged and removed, the first programmable lamp 27 is able to selectively switch the source of the power, that is, either from an external power supply or a power module built inside the first programmable lamp 27. In this case, the first programmable lamp 27 could be a stand-alone lamp and could be placed everywhere according to user's preference while it is removed from the main structure 25.

In order to provide a further understanding of this invention. The following explanations will take a honeycomb-like light programmable apparatus as an example to further explain how to implement the light programmable lamp 73, setting device 71, and light programmable apparatus 75 in such example. Although the internal implementation of the LED module may be arranged in a single color light style or a mixed color light style as shown in FIGS. 4A and 4B, the following explanations will use the latter style as example for the sake of simplicity.

Figure 7A:
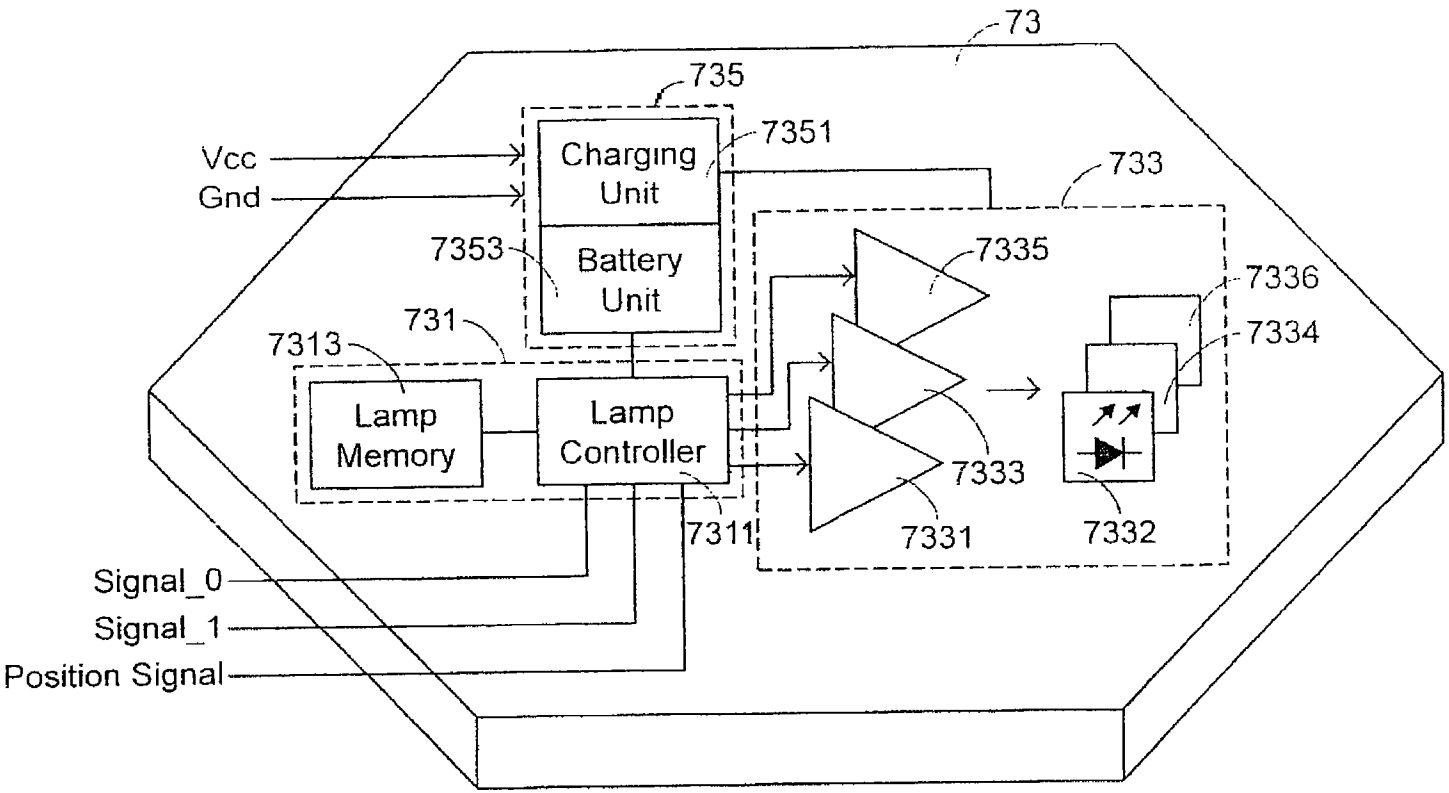
FIG. 7A is a general illustration of a light programmable lamp applied to a cell-like element.

FIG. 7A is a general illustration of a light programmable lamp 73 applied to a cell-like element. Basically speaking, the cell-like lamp comprises three main parts, i.e. the LED module 733, the programmable unit 731 and the power module 735. Based on the discussion above, the LED module 733 comprises three LED units 7332, 7334, 7336 and three driver units 7331, 7333, 7335. The LED units 7332, 7334, 7336 are driven by the driving currents generated by the driver units 7331, 7333, 7335 corresponding to three different colors.

As for the intensities of these light colors are controlled by the lamp controller 7311 of the programmable unit 731. The lamp controller 7311 is electrically connected to the lamp memory 7313 and the LED module 733, for fetching the light property setting from the lamp memory 7313 and controlling the LED module 733 to emit the mixed color light. It is possible to use a charging unit 7351 and a battery unit 7353 in order to supply the power needed by the lamp controller 7311 and LED module 733.

Although a plurality of LED units 7332, 7334, 7336 and corresponding driver units 7331, 7333, 7335 are provided in this embodiment to emit a mixed color light, it is to be noted that the present invention can be applied to a light programmable lamp 73 emitting a single color light or a white light. In this case, light intensity is the only light property adjusted by the lamp controller 7311.

Figure 7B:
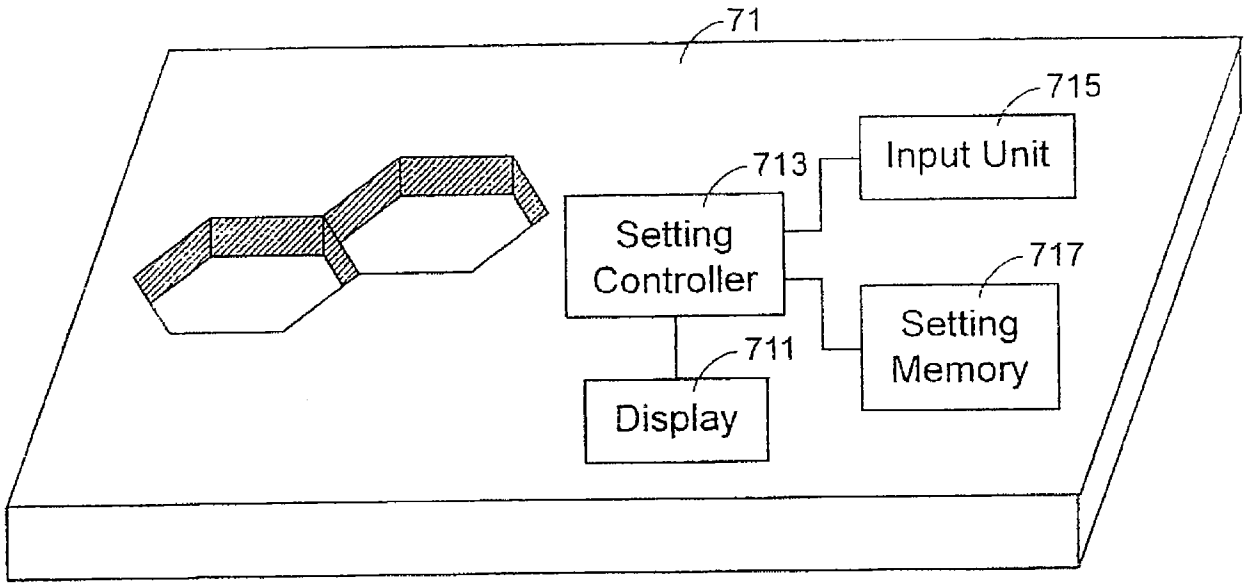
FIG. 7B is a general illustration of a setting device applied to a honeycomb-like embodiment.

FIG. 7B is a general illustration of a setting device applied to a honeycomb-like light programmable apparatus. The setting device 71 comprises a setting controller 713, for retrieving and providing the light property setting to the cell-like light programmable lamp 73 while the cell-like light programmable lamp 73 is selectively electrically connected to the setting device 71. Inside the setting device 71, there might also be a setting memory 717, an input unit 715, and a display 711. The setting memory 717 and the input unit 715 are used to provide light property settings for the setting controller 713. On the other hand, the display 711 is used to show details of the light property settings.

The realization of devices mentioned above may be changed according to the system. For instance, the input unit 715 may be implemented as a color sensor, for detecting the light property setting via a card reader. Besides, the input unit 715 may be implemented as a push button, encoder or touch screen/panel . . . , etc, for receiving the light property setting via a user's operation.

Figure 7C:
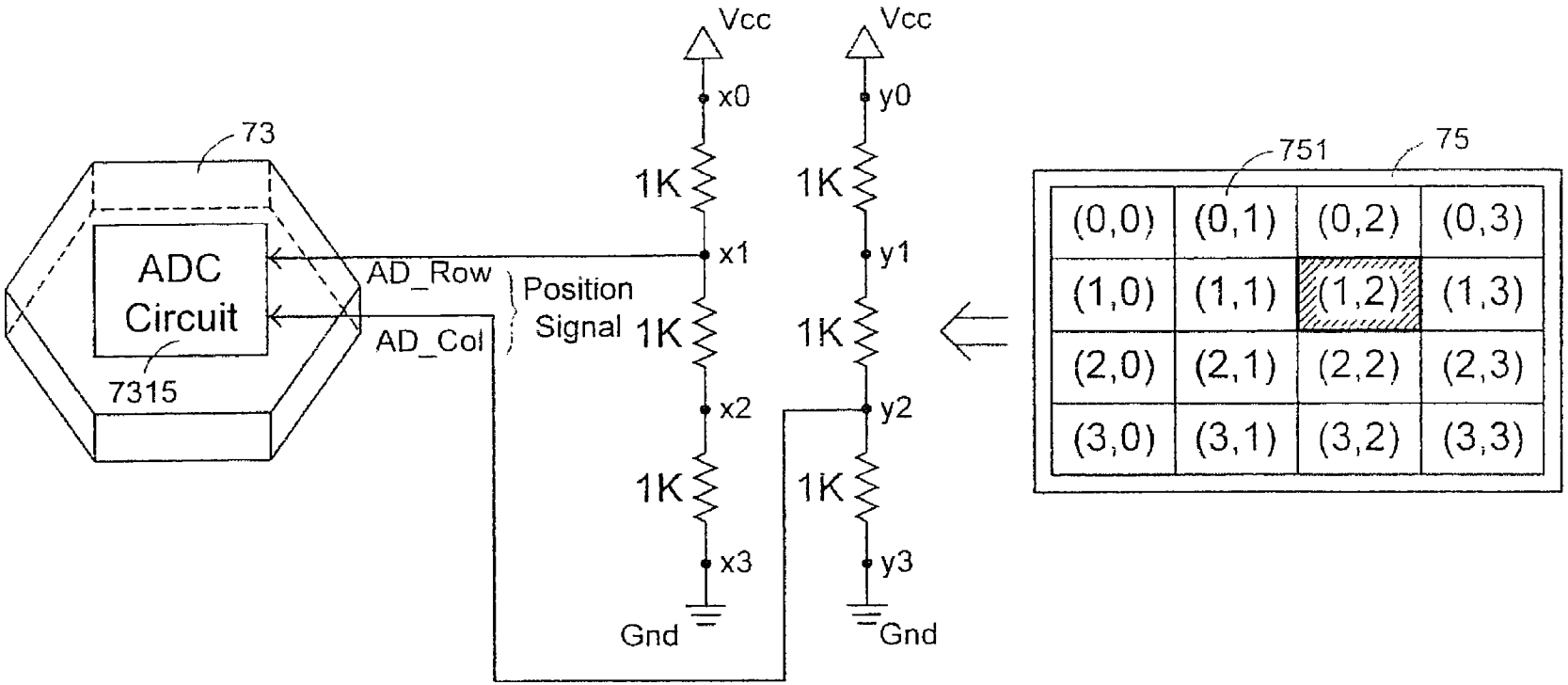
FIG. 7C is a general illustration of a light programmable lamp with a detective circuit embedded in a main structure to detect a position of the light programmable lamp.

FIG. 7C is a general illustration of a light programmable lamp 73 with a detective circuit 7315 to detect a position signal of the light programmable lamp 73. Sometimes, the light programmable lamp 73 is with a detective ADC circuit 7315 inside the programmable unit 731, selectively electrically connected to a position indicating circuit 751 embedded in the main structure 75, for detecting a position signal of the light programmable lamp 73. In this embodiment, an ADC circuit 7315 is used.

According to FIG. 7C, the light programmable lamps 73 removably arranged on the main structure 75 may construct as a 4×4 matrix. The position indicating circuit 751 is composed of two serials of resistors, one represents a row position layout and the other one represents a column position layout. In the serial of resistors that represents the row position layout, there are three 1 k resistors being connected in series that create 4 points (x0, x1, x2, x3) for selection. Similarly, there are three 1 k resistors being connected in series in the column position layout, and another 4 points (y0, y1, y2, y3) can be chosen to connect. Therefore, once the light programmable lamp 73 is connected to the main structure 75, the position of the light programmable lamp 73 will be determined by the pair of points being connected. It is possible to get the voltage at each point in the row and in the column position layout. With the ADC type of position indicating circuit 751, the ADC circuit 7315 in FIG. 7C is capable of detecting the relative position of the light programmable lamp 73 on the main structure 75.

Figure 7D:
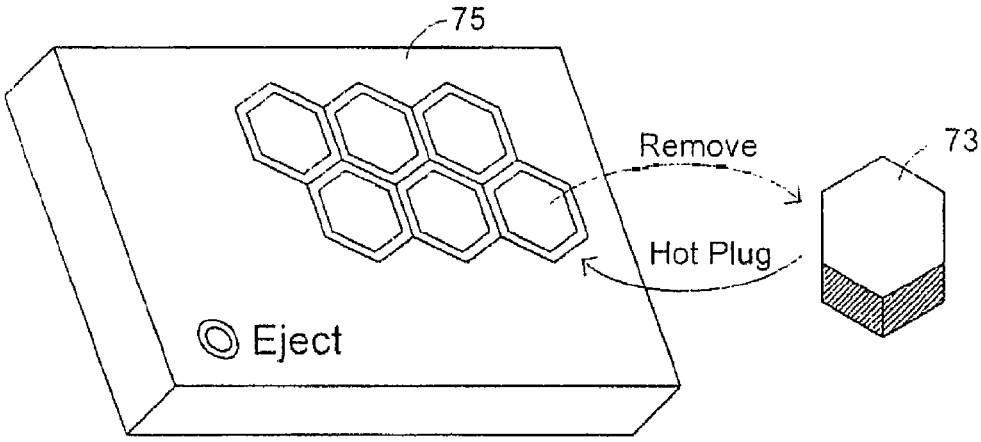
FIG. 7D is a general illustration of the hot plug function provided by a cell-like light programmable lamp.

FIG. 7D is a general illustration of the hot plug function provided by a cell-like light programmable lamp. A plurality of light programmable lamps 73 are removably arranged on the main structure 75 in this embodiment.

The application of the hot plug function varies according if the setting device 71 is embedded in the main structure 75 or not. In both cases, the detective circuit 7315 of the programmable unit 731 will automatically detect relative parameter of the physical position while the light programmable lamp 73 is hot plugged to any position on the main structure 75.

In the case that the setting device 71 is embedded in the main structure 75, the lamp controller 7311 will receive different light property setting from the setting device 71 while the light programmable lamp 73 is placed at different position on the main structure 75.

To be more precisely, the programmable unit 731 in this case does not only detect the position of the light programmable lamp 73 via the detective circuit 7315, but also receive relative commands or parameters representing light property setting corresponding to the position via the setting device 71.

On the other hand, if there is no setting device 71 built in the main structure 75, the LED module 733 will emit light with the same light property as before the light programmable lamp 73 is removed from the first position and plugged to the second position. In this case, the light property setting is stored in the lamp memory 7313, and the light property setting will be read by the lamp controller 7311 for passing relative control signals to the LED module 733.

Besides the core components mentioned above, some small components might also be applied to the light programmable apparatus, for example, with an eject button on the surface of the main structure 75, a user may press the button and remove all cell-like light programmable lamps at once.

Figure 8A:
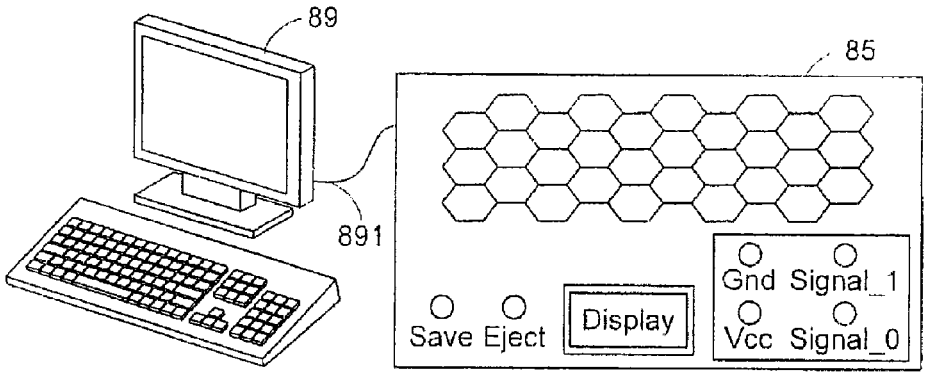
FIG. 8A is a general illustration of a light programmable apparatus connected to a pattern providing device for image settings.

FIG. 8A is a general illustration of a light programmable apparatus connected to a light property providing device for group pattern settings. The light programmable apparatus 85 is electrically connected to a PC 89 for light property settings via a serial communication cable such as a USB cable 891. The PC 89 represents a light property providing device, and other devices like a digital album or so, to provide light property settings to the light programmable apparatus 85 may be applied too.

Figure 8B:
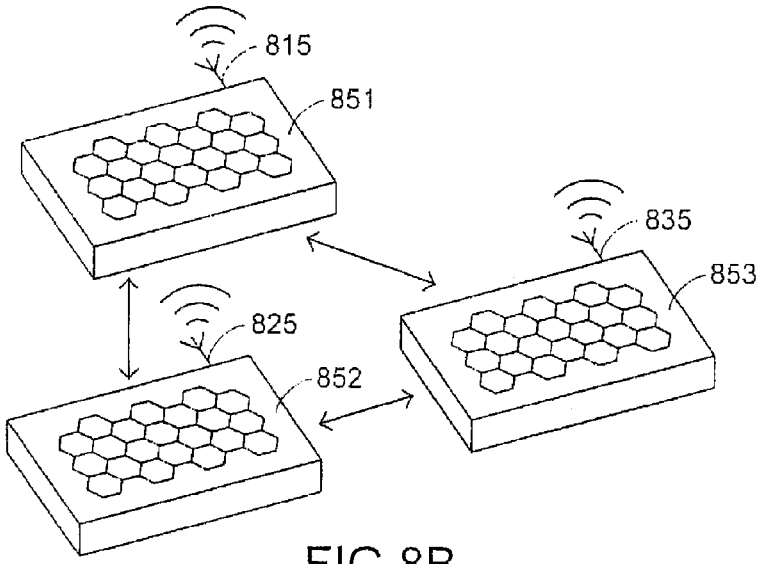
FIG. 8B is a general illustration of several light programmable apparatuses with data ports in communication with each other via a wireless network.

FIG. 8B is a general illustration of a light programmable system with several light programmable apparatuses in communication with each other via a wireless network. In this embodiment, there are three light programmable apparatuses 851, 852, 853 all together; each of these light programmable apparatuses 851, 852, 853 is with a data port 815, 825, 835. Through the communication between the data ports 815, 825, 835, these light programmable apparatuses 851, 852, 853 are capable of transferring light property settings between each other.

According to the embodiment, it is easy to notice that the light programmable lamp 23 proposed in this invention can be very flexible. In addition, it can even be applied to an entertainment apparatus like a board game or a jigsaw puzzle.

For example, in a jigsaw puzzle application, the light programmable lamp 23 is applied to a puzzle element, the main structure 25 is like an assemble board, and the setting device 21 provides user to choose the color or light pattern what to assemble.

Furthermore, the light programmable apparatus may be used in a board game application like chess, tic-tac-toe or Gomoku. In the case of a chess application, the light programmable lamps 23 are in the shape of chessman, and the main structure 25 is in the shape of chess board. As for the application in tic-tac-toe, or Gomoku, the light programmable lamps 23 are grouped in two colors to represent different colors of elements, and the main structure 25 may be made as a plate surface with grids on it.

While the present invention has been discussed in terms of the preferred embodiment, various modifications, omissions, additions and different designs without departing from the principle of the invention should be obvious to those skilled in the art. Therefore, the present invention should be understood as including all possible embodiments, modifications, omissions, additions and so forth which can be implemented without departing from the principle of the invention set forth in the appended claims.

What is claimed is:

1. A light programmable lamp selectively electrically connected to a setting device, for retrieving a light property setting from the setting device, the light programmable lamp comprising:

a programmable unit retrieving and storing the light property setting while the light programmable lamp is selectively electrically connected to the setting device; and a LED module, electrically connected to the programmable unit, for emitting light corresponding to the light property setting, wherein the programmable unit comprises a detective circuit, selectively electrically connected to a position indicating circuit embedded in a main structure, for detecting a position signal corresponding to the light programmable lamp.

2. The light programmable lamp according to claim 1, wherein the light programmable lamp further comprises a power module, electrically connected to the programmable unit and the LED module, for providing power utilized by the LED module.

3. The light programmable lamp according to claim 2, wherein the power module comprises a battery unit, electrically connected to the LED module, for providing the power.

4. The light programmable lamp according to claim 3, wherein the power module further comprises a charging unit, electrically connected to the battery unit, for charging the battery unit from an external power supply.

5. The light programmable lamp according to claim 1, wherein the programmable unit comprises:

a lamp memory, for storing the light property setting; and a lamp controller, electrically connected to the lamp memory and the LED module, for fetching the light property setting from the lamp memory and controlling the LED module to emit light.

6. The light programmable lamp according to claim 5, wherein the lamp controller is capable of converting the light property setting to a light signal, and the LED module comprises:

a driver unit, electrically connected to the lamp controller, for receiving the light signal from the lamp controller and generating a driving current; and a LED unit, electrically connected to the driver unit, for emitting a light in response to the driving current.

7. The light programmable lamp according to claim 5, wherein the lamp controller is capable of converting the light property setting to a first light signal, a second light signal and a third light signal, and the LED module comprises:

a first driver unit, electrically connected to the lamp controller, for receiving the first light signal from the lamp controller and generating a first driving current;

a second driver unit, electrically connected to the lamp controller, for receiving the second light signal from the lamp controller and generating a second driving current;

a third driver unit, electrically connected to the lamp controller, for receiving the third light signal from the lamp controller and generating a third driving current;

a first LED unit, electrically connected to the first driver unit, for emitting a first light in response to the first driving current;

a second LED unit, electrically connected to the second driver unit, for emitting a second light in response to the second driving current; and a third LED unit, electrically connected to the third driver unit, for emitting a third light in response to the third driving current, wherein the light is the mixture of the first light, the second light, and the third light.

8. The light programmable lamp according to claim 7, wherein the first LED unit is a red color LED unit, the second LED unit is a green color LED unit, and the third LED unit is a blue color LED unit.

9. The light programmable lamp according to claim 1, wherein the light property setting is the intensity, saturation or color of the light.

10. A light programmable apparatus comprising:

a setting device for providing a first light property setting; and a first light programmable lamp, selectively electrically connected to the setting device, wherein the first light programmable lamp comprises:

a first programmable unit for retrieving and storing the first light property setting while the first light programmable lamp is selectively electrically connected to the setting device; and a first LED module, electrically connected to the first programmable unit, for emitting a first light corresponding to the first light property setting, wherein the first light programmable lamp is with a hot plug function, and when the first programmable lamp is hot plugged to a position on the light programmable apparatus, the first programmable lamp receives the first light property setting corresponding to the position.

11. The light programmable apparatus according to claim 10, wherein the setting device comprises a setting controller, for retrieving and saving the first light property setting to the first light programmable lamp while the first light programmable lamp is selectively electrically connected to the setting device.

12. The light programmable apparatus according to claim 11, wherein the setting device further comprises a setting memory, electrically connected to the setting controller, for providing a light property mapping table with a plurality of light property settings.

13. The light programmable apparatus according to claim 11, wherein the setting device further comprises an input unit, electrically connected to the setting controller, for providing the light property setting to the setting controller.

14. The light programmable apparatus according to claim 13, wherein the input unit is a color sensor, for detecting the first light property setting via a property setting reader.

15. The light programmable apparatus according to claim 13, wherein the input unit is a push button, encoder or touch screen/panel, for receiving the first light property setting via a user's operation.

16. The light programmable apparatus according to claim 11, wherein the setting device further comprises a display, electrically connected to the setting controller, for showing the first light property setting.

17. The light programmable apparatus according to claim 10, wherein the light programmable apparatus further comprises a second light programmable lamp, selectively electrically connected to the setting device, wherein the setting device provides a second light property setting, and the second light programmable lamp comprises:

a second programmable unit for retrieving and storing the second light property setting while the second light programmable lamp is selectively electrically connected to the setting device; and a second LED module, electrically connected to the second programmable unit, for emitting a second light corresponding to the second light property setting.

18. The light programmable apparatus according to claim 10, wherein the first programmable lamp receives the source of the power by switching between an external power supply and a built-in battery unit.

19. The light programmable apparatus according to claim 10, further comprising a main structure, wherein the first light programmable lamp is removably arranged on the main structure.

20. The light programmable apparatus according to claim 19, wherein the light programmable apparatus further comprises a plurality of light programmable lamps, removably arranged on the main structure, wherein the position of each light programmable lamp is changeable.

21. The light programmable apparatus according to claim 19, wherein the main structure comprises a position indicating circuit for providing a position signal to the light programmable lamp.

22. The light programmable apparatus according to claim 19, wherein the main structure comprises a connector for providing an interface between the light programmable lamp and the setting device.

23. The light programmable apparatus according to claim 10, wherein the light programmable apparatus further comprises a data port for transmitting and receiving the first light property setting to and from an another light programmable apparatus.

24. The light programmable apparatus according to claim 10, wherein the first light property setting is the intensity, saturation or color of the first light.

* * * * *